US012514287B2

(12) United States Patent
Yuan

(10) Patent No.: US 12,514,287 B2
(45) Date of Patent: Jan. 6, 2026

(54) BATTERY ROD AND ELECTRONIC VAPORIZATION DEVICE

(71) Applicant: SHENZHEN SMOORE TECHNOLOGY LIMITED, Guangdong (CN)

(72) Inventor: Huakai Yuan, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 750 days.

(21) Appl. No.: 17/820,609

(22) Filed: Aug. 18, 2022

(65) Prior Publication Data

US 2023/0057256 A1 Feb. 23, 2023

(30) Foreign Application Priority Data

Aug. 19, 2021 (CN) ..... 202121980598.7

(51) Int. Cl.
*A24F 40/40* (2020.01)
*A24F 40/51* (2020.01)
*A24F 40/57* (2020.01)

(52) U.S. Cl.
CPC ..... *A24F 40/40* (2020.01); *A24F 40/51* (2020.01); *A24F 40/57* (2020.01)

(58) Field of Classification Search
CPC ..... A24F 40/40; A24F 40/57; A24F 40/51; A24F 40/53; A24F 40/10; A24F 40/465; A24F 40/485; H05B 1/0297; H05B 1/0211; H05B 3/0014; H05B 1/0227; H05B 6/666
See application file for complete search history.

(56) References Cited

U.S. PATENT DOCUMENTS

2017/0325507 A1* 11/2017 Xiang ..... F22B 1/284
2020/0375258 A1* 12/2020 Mizuguchi ..... H03F 3/45475

FOREIGN PATENT DOCUMENTS

CN 106102488 B 10/2019

* cited by examiner

*Primary Examiner* — Brian W Jennison
(74) *Attorney, Agent, or Firm* — Leydig, Voit & Mayer, Ltd.

(57) ABSTRACT

A battery rod includes: a first connection terminal and a second connection terminal, to be connected to a vaporizer, the first connection terminal supplying a working voltage to the vaporizer and the second connection terminal supplying a ground voltage to the vaporizer during power supply of the battery rod to the vaporizer; and a detection unit connected to the first connection terminal and the second connection terminal for detecting a temperature of a thermocouple formed by a vaporization element in the vaporizer, and supplying a reference voltage to the second connection terminal to detect a temperature of the vaporization element in the vaporizer connected to the battery rod in a forward direction or a reverse direction.

8 Claims, 2 Drawing Sheets

BATTERY ROD AND ELECTRONIC VAPORIZATION DEVICE

CROSS-REFERENCE TO PRIOR APPLICATION

Priority is claimed to Chinese Patent Application No. CN 202121980598.7, filed on Aug. 19, 2021, the entire disclosure of which is hereby incorporated by reference herein.

FIELD

The present disclosure relates to the field of electronic vaporization devices, and in particular, to a battery rod and an electronic vaporization device.

BACKGROUND

In the existing electronic vaporization products, the traditional control method is constant temperature control, and the constant temperature control method is required to collect the temperature of the vaporizer through thermoelectric potential. The signal collected through the thermoelectric potential has a problem of polarity. It is necessary to correctly connect the vaporizer to positive and negative poles of the battery rod. If the vaporizer and the battery rod are reversely connected, an error in signal identification may be caused, and the temperature cannot be measured.

SUMMARY

In an embodiment, the present invention provides a battery rod, comprising: a first connection terminal and a second connection terminal, configured to be connected to a vaporizer, the first connection terminal being configured to supply a working voltage to the vaporizer and the second connection terminal being configured to supply a ground voltage to the vaporizer during power supply of the battery rod to the vaporizer; and a detection unit connected to the first connection terminal and the second connection terminal and configured to detect a temperature of a thermocouple formed by a vaporization element in the vaporizer, and to supply a reference voltage to the second connection terminal to detect a temperature of the vaporization element in the vaporizer connected to the battery rod in a forward direction or a reverse direction.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
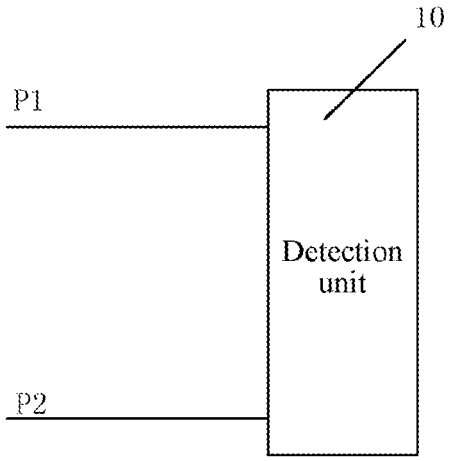
FIG. 1 is a schematic diagram of a function module of a battery rod according to a first embodiment of the present disclosure.

In an embodiment, the present invention provides a battery rod and an electronic vaporization device. In this way, the battery rod of the present disclosure can detect a temperature of a vaporization element of a vaporizer when connected to the vaporizer in either a forward direction or a reverse direction, thereby realizing accurate vaporization control at a constant temperature.

In an embodiment, the present invention provides a battery rod, including: a first connection terminal and a second connection terminal, configured to be connected to a vaporizer, where the first connection terminal is configured to supply a working voltage to the vaporizer and the second connection terminal is configured to supply a ground voltage to the vaporizer during power supply of the battery rod to the vaporizer; and a detection unit, connected to the first connection terminal and the second connection terminal and configured to detect a temperature of a thermocouple formed by a vaporization element in the vaporizer, and supply a reference voltage to the second connection terminal to detect a temperature of the vaporization element in the vaporizer connected to the battery rod in a forward direction or a reverse direction.

The battery rod further includes: an upper arm driving unit, connected to the first connection terminal and configured to supply the working voltage to the vaporizer by using the first connection terminal during the power supply of the battery rod to the vaporizer; and a lower arm driving unit, connected to the second connection terminal and configured to supply the ground voltage to the vaporizer by using the second connection terminal during the power supply of the battery rod to the vaporizer; and stop supplying the ground voltage to the second connection terminal when the detection unit detects the temperature of the vaporization element, so that a potential at the second connection terminal varies with a potential of the reference voltage supplied by the detection unit.

When the battery rod is connected to the vaporizer in the forward direction and the detection unit detects the temperature of the vaporization element, a high potential terminal of the thermocouple formed by the vaporization element is connected to the first connection terminal, and a low potential terminal of the thermocouple is connected to the second connection terminal. The detection unit detects a first detection voltage signal between the first connection terminal and the second connection terminal indicating the temperature of the vaporization element. The first detection voltage signal is higher than the reference voltage. When the battery rod is connected to the vaporizer in the reverse direction and the detection unit detects the temperature of the vaporization element, a high potential terminal of the thermocouple formed by the vaporization element is connected to the second connection terminal, and a low potential of the thermocouple is connected to the first connection terminal. The detection unit detects a second detection voltage signal between the first connection terminal and the second connection terminal indicating the temperature of the vaporization element. The second detection voltage signal is lower than the reference voltage and higher than the ground voltage.

The detection unit includes: a reference voltage supply circuit, connected to the second connection terminal to supply the reference voltage to the second connection terminal; and a signal amplification circuit, connected to the first connection terminal and the second connection terminal to amplify the first detection voltage signal or the second detection voltage signal, so as to generate an amplified detection signal.

The battery rod further includes: a control unit, connected to the signal amplification circuit and the reference voltage supply circuit, to determine the temperature of the vaporization element based on the reference voltage and the amplified detection signal.

The upper arm driving unit includes: a first switch, including a control terminal, a first connecting terminal, and a second connecting terminal, where the control terminal of the first switch is connected to the control unit, the first connecting terminal is configured to receive the working voltage, and the second connecting terminal is connected to the first connection terminal. The lower arm driving unit includes: a second switch, including a control terminal, a first connecting terminal, and a second connecting terminal, where the control terminal of the second switch is connected to the control unit, the first connecting terminal is configured to receive the ground voltage, and the second connecting terminal is connected to the second connection terminal. In a heating stage of vaporization, the control unit controls the first switch and the second switch to be turned on, so that the upper arm driving unit supplies the working voltage to the first connection terminal by using the first switch that is turned on, and the lower arm driving unit supplies the ground voltage to the second connection terminal by using the second switch that is turned on. In a temperature detection stage, the control unit controls the first switch and the second switch to be turned off to stop supplying the working voltage to the first connection terminal and the ground voltage to the second connection terminal, so that the reference voltage supplied by the detection unit causes the potential at the second connection terminal to vary with the potential of the reference voltage.

The upper arm driving unit further includes a first resistor, connected between the control terminal of the first switch and the first connecting terminal. The lower arm driving unit further includes a second resistor, connected between the control terminal of the second switch and the first connecting terminal.

The first switch is a P-type MOS transistor, and the second switch is an N-type MOS transistor.

The battery rod further includes: a compensation temperature sensor, arranged close to the first connection terminal and the second connection terminal of the battery rod and configured to detect a cold end temperature of the thermocouple formed by the vaporization element when the vaporizer is connected to the battery rod and the detection unit detects the temperature of the vaporization element, so as to further accurately detect the temperature of the vaporization element.

To resolve the foregoing technical problems, the present disclosure provides a second technical solution: An electronic vaporization device is provided, including: a vaporizer and a battery rod, where the battery rod is the battery rod according to any of the above.

The beneficial effects of the present disclosure are different from the prior art. The battery rod provided in the present disclosure includes: a first connection terminal and a second connection terminal, configured to be connected to a vaporizer, where the first connection terminal is configured to supply a working voltage to the vaporizer and the second connection terminal is configured to supply a ground voltage to the vaporizer during power supply of the battery rod to the vaporizer; and a detection unit, connected to the first connection terminal and the second connection terminal and configured to detect a temperature of a thermocouple formed by a vaporization element in the vaporizer, and supply a reference voltage to the second connection terminal to detect a temperature of the vaporization element in the vaporizer connected to the battery rod in a forward direction or a reverse direction. In this way, the battery rod of the present disclosure can detect the temperature of the vaporization element of the vaporizer when connected to the vaporizer in either the forward direction or the reverse direction, thereby realizing accurate vaporization control at a constant temperature.

The following clearly and completely describes the technical solutions in the embodiments with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

Referring to FIG. 1, FIG. 1 is a schematic structural diagram of an embodiment of a battery rod according to the present disclosure. Specifically, the battery rod includes a first connection terminal P1 and a second connection terminal P2. The first connection terminal P1 and the second connection terminal P2 are configured to be connected to a vaporizer. The first connection terminal P1 is configured to supply a working voltage to the vaporizer and the second connection terminal P2 is configured to supply a ground voltage to the vaporizer during power supply of the battery rod to the vaporizer. The battery rod further includes a detection unit 10 connected to the first connection terminal P1 and the second connection terminal P2. The detection unit 10 is configured to detect a temperature of a thermocouple formed by a vaporization element in the vaporizer, and supply a reference voltage to the second connection terminal P2 to detect a temperature of the vaporization element in the vaporizer connected to the battery rod in a forward direction or a reverse direction.

Specifically, when the battery rod is connected to the vaporizer in the forward direction, the first connection terminal P1 of the battery rod is connected to a first terminal of the vaporizer, and the second connection terminal P2 of the battery rod is connected to a second terminal of the vaporizer. The first terminal of the vaporizer receives the working voltage, and the second terminal of the vaporizer receives the ground voltage. When the battery rod is connected to the vaporizer in the reverse direction, the first connection terminal P1 of the battery rod is connected to the second terminal of the vaporizer, and the second connection terminal P2 of the battery rod is connected to the first terminal of the vaporizer. The second terminal of the vaporizer receives the working voltage, and the first terminal of the vaporizer receives the ground voltage.

Figure 2:
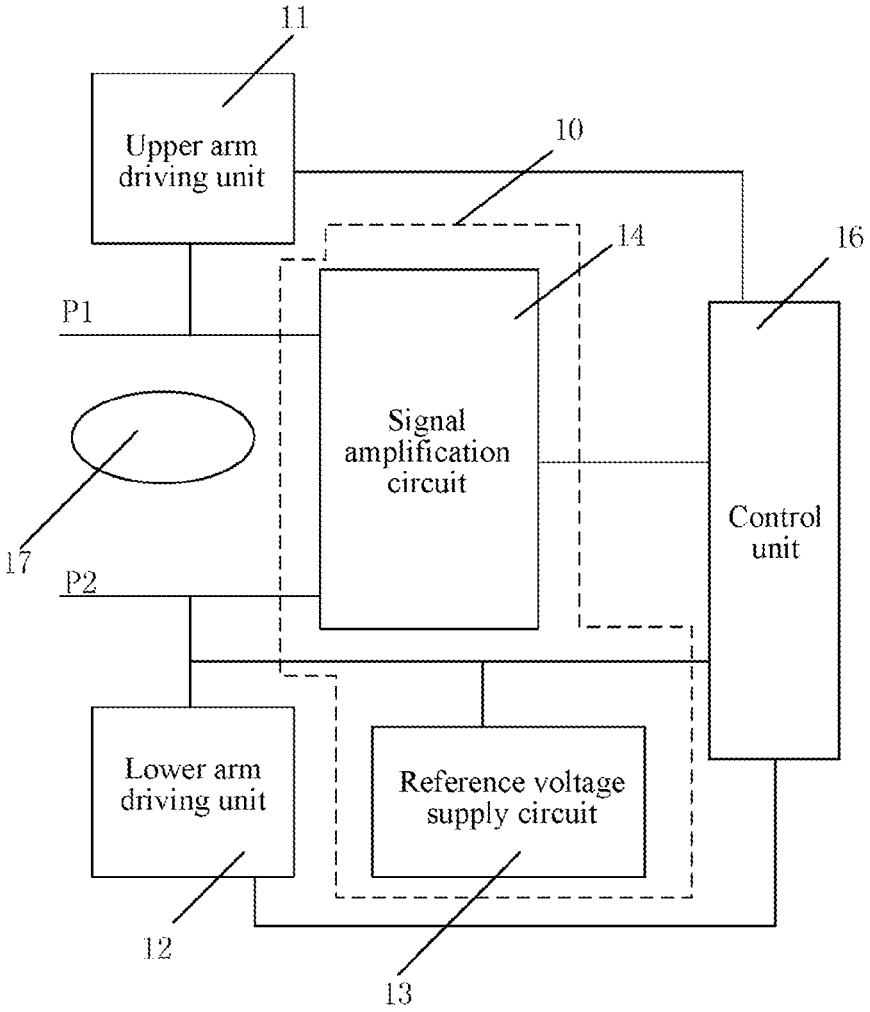
FIG. 2 is a schematic diagram of function modules of a battery rod according to a first embodiment of the present disclosure.

Referring to FIG. 2, FIG. 2 is a schematic structural diagram of a second embodiment of a battery rod according to the present disclosure. The battery rod further includes an upper arm driving unit 11 and a lower arm driving unit 12. The upper arm driving unit 11 is connected to the first connection terminal P1 and configured to supply the working voltage to the vaporizer by using the first connection terminal P1 during power supply of the battery rod to the vaporizer. The lower arm driving unit 12 is connected to the second connection terminal P2 and configured to supply the ground voltage to the vaporizer by using the second connection terminal P2 during the power supply of the battery rod to the vaporizer. Further, the lower arm driving unit 12 stops supplying the ground voltage to the second connection terminal P2 when the detection unit 10 detects the temperature of the vaporization element, so that a potential at the second connection terminal P2 varies with a potential of the reference voltage supplied by the detection unit 10.

Specifically, when the battery rod is connected to the vaporizer in the forward direction and the detection unit 10 detects the temperature of the vaporization element, a high potential terminal of the thermocouple formed by the vaporization element is connected to the first connection terminal P1, and a low potential terminal of the thermocouple is connected to the second connection terminal P2. The detection unit 10 detects a first detection voltage signal between the first connection terminal P1 and the second connection terminal P2 indicating the temperature of the vaporization element. The first detection voltage signal is higher than the reference voltage.

When the battery rod is connected to the vaporizer in the reverse direction and the detection unit 10 detects the temperature of the vaporization element, a high potential terminal of the thermocouple formed by the vaporization element is connected to the second connection terminal P2, and a low potential of the thermocouple is connected to the first connection terminal P1. The detection unit 10 detects a second detection voltage signal between the first connection terminal P1 and the second connection terminal P2 indicating the temperature of the vaporization element. The second detection voltage signal is lower than the reference voltage and higher than the ground voltage.

In a specific embodiment, the detection unit 10 includes a reference voltage supply circuit 13 and a signal amplification circuit 14. The reference voltage supply circuit 13 is connected to the second connection terminal P2 to supply the reference voltage to the second connection terminal P2. The signal amplification circuit 14 is connected to the first connection terminal P1 and the second connection terminal P2 to amplify the first detection voltage signal or the second detection voltage signal, so as to generate an amplified detection signal.

In a specific embodiment, the battery rod further includes a control unit 16, connected to the signal amplification circuit 14 and the reference voltage supply circuit 13, to determine the temperature of the vaporization element based on the reference voltage and the amplified detection signal.

Specifically, in an embodiment, when the battery rod is connected to the vaporizer in the forward direction and the temperature of the vaporization element is detected, the first connection terminal P1 is connected to the high potential terminal of the thermocouple formed by the vaporization element. At this time, the signal amplification circuit 14 receives the first detection voltage signal indicating the temperature of the vaporization element, amplifies the first detection voltage signal, and outputs the amplified detection signal. The control unit determines the temperature of the vaporization element based on the amplified detection signal and the reference voltage. It should be noted that, at this point, the temperature of the vaporization element is equal to the amplified detection signal minus the reference voltage.

In another embodiment, when the battery rod is connected to the vaporizer in the reverse direction and the temperature of the vaporization element is detected, the second connection terminal P2 is connected to the high potential terminal of the thermocouple formed by the vaporization element. At this time, the signal amplification circuit 14 receives the second detection voltage signal indicating the temperature of the vaporization element, amplifies the second detection voltage signal, and outputs the amplified detection signal. The control unit determines the temperature of the vaporization element based on the amplified detection signal and the reference voltage. It should be noted that, at this point, the temperature of the vaporization element is equal to the reference voltage minus the amplified detection signal.

Figure 3:
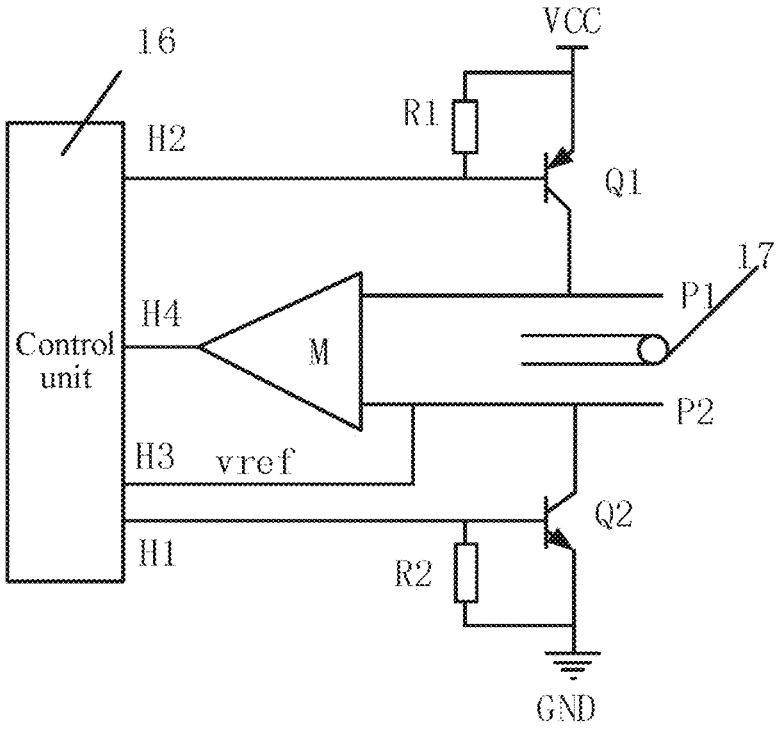
FIG. 3 is a schematic diagram of a circuit structure of the battery rod provided in FIG. 2.

In a specific embodiment, referring to FIG. 3, the upper arm driving unit 11 includes a first switch Q1 and a first resistor R1. The first switch Q1 includes a control terminal, a first connecting terminal, and a second connecting terminal. The control terminal of the first switch Q1 is connected to a port H2 of the control unit 16, the first connecting terminal is configured to receive the working voltage VCC, and the second connecting terminal is connected to the first connection terminal P1. A first terminal of the first resistor R1 is connected to the first connecting terminal of the first switch Q1, and a second terminal of the first resistor R1 is connected to the control terminal of the first switch Q1.

The lower arm driving unit 12 includes A second switch Q2 and a second resistor R2. The second switch Q2 includes a control terminal, a first connecting terminal, and a second connecting terminal. The control terminal of the second switch Q2 is connected to a port H1 of the control unit 16, the first connecting terminal is configured to receive the ground voltage GND, and the second connecting terminal is connected to the second connection terminal P2. A first terminal of the second resistor R2 is connected to the control terminal of the second switch Q2, and a second terminal of the second resistor R2 is connected to the first connecting terminal of the second switch Q2.

In a heating stage of vaporization, the control unit 16 controls the first switch Q1 and the second switch Q2 to be turned on, so that the upper arm driving unit 11 supplies the working voltage VCC to the first connection terminal P1 by using the first switch Q1 that is turned on, and the lower arm driving unit 12 supplies the ground voltage to the second connection terminal P2 by using the second switch Q2 that is turned on.

In an embodiment, the first switch Q1 and the second switch Q2 may be MOS transistors such as PMOS transistors or NMOS transistors. In another embodiment, the first switch Q1 and the second switch Q2 may be triodes, for example, NPN or PNP, which is not specifically limited.

Specifically, in the heating stage of vaporization, the port H2 of the control unit 16 outputs a control signal to control the first switch Q1 to be turned on, and the port H1 outputs a control signal to control the second switch Q2 to be turned on. At this point, the upper arm driving unit 11 supplies the working voltage VCC to the first connection terminal P1 by using the first switch Q1 that is turned on, and the lower arm driving unit 12 supplies the ground voltage to the second connection terminal P2 by using the second switch Q2 that is turned on. At this time, an output terminal H4 of the signal amplification circuit 14 outputs a high-level signal, and temperature detection is not performed.

In a temperature detection stage, the control unit 16 controls the first switch Q1 and the second switch Q2 to be turned off to stop supplying the working voltage VCC to the first connection terminal P1 and the ground voltage GND to the second connection terminal P2, so that the reference voltage supplied by the reference voltage supply circuit 13 of the detection unit 10 causes the potential at the second connection terminal P2 to vary with the potential of the reference voltage.

Specifically, when the vaporizer is connected to the battery rod in the forward direction and in the temperature detection stage, the first switch Q1 and the second switch Q2 are turned off, and the output terminal H4 of the signal amplification circuit 14 outputs an amplified detection signal. The control unit can determine the temperature of the vaporization element based on the amplified detection signal and the reference voltage. Specifically, at this point, the temperature of the vaporization element is equal to the amplified detection signal minus the reference voltage. Specifically, when the vaporizer is connected to the battery rod in the reverse direction and in the temperature detection stage, the first switch Q1 and the second switch Q2 are turned off, and the output terminal H4 of the signal amplification circuit 14 outputs an amplified detection signal. The control unit can determine the temperature of the vaporization element based on the amplified detection signal and the reference voltage. Specifically, at this point, the temperature of the vaporization element is equal to the reference voltage minus the amplified detection signal.

In an embodiment, in order to ensure the accuracy of temperature detection, the battery rod further includes a compensation temperature sensor 17. The compensation temperature sensor 17 is arranged close to the first connection terminal P1 and the second connection terminal P2 of the battery rod, and is configured to detect a cold end temperature of the thermocouple formed by the vaporization element when the vaporizer is connected to the battery rod and the detection unit 10 detects the temperature of the vaporization element, so as to further accurately detect the temperature of the vaporization element.

In an embodiment, the compensation temperature sensor 17 is connected to the control unit 16. The control unit 16 detects, by using the compensation temperature sensor 17, the cold end temperature of the thermocouple formed by the vaporization element, and accurately obtains the temperature of the vaporization element according to the amplified detection signal and the reference voltage.

The upper arm driving unit and the lower arm driving unit are arranged on the battery rod of the present disclosure, so as to ensure that the battery rod can detect the temperature of the vaporization element when connected to the vaporizer in either the forward direction or the reverse direction, thereby realizing an accurate vaporization control mode at a constant temperature.

Figure 4:
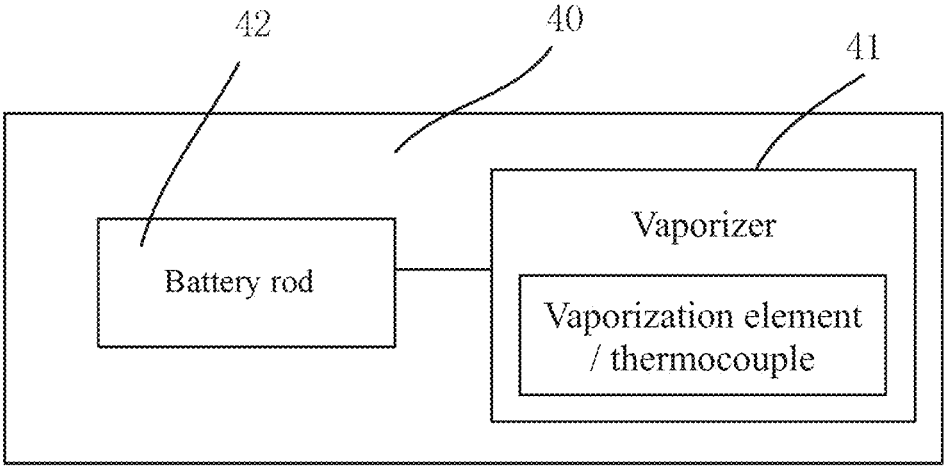
FIG. 4 is a schematic structural diagram of an electronic vaporization device according to a first embodiment of the present disclosure.

Referring to FIG. 4, FIG. 4 is a schematic structural diagram of an embodiment of an electronic vaporization device according to the present disclosure. The electronic vaporization device 40 includes a vaporizer 41 and a battery rod 42. The battery rod 42 is the battery rod according to any of the embodiments of FIG. 1 to FIG. 3. The upper arm driving unit and the lower arm driving unit are arranged on the battery rod of the present disclosure, so as to ensure that the battery rod can detect the temperature of the vaporization element when connected to the vaporizer in either the forward direction or the reverse direction, thereby realizing an accurate vaporization control mode at a constant temperature.

The foregoing are only the embodiments of the present disclosure, and are not intended to limit the patent scope of the present disclosure. Any equivalent modifications made to the structures or processes based on the content of the specification and the accompanying drawings of the present disclosure for direct or indirect use in other relevant technical fields shall also be encompassed in the patent protection scope of the present disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A battery rod, comprising:

a first connection terminal and a second connection terminal, configured to be connected to a vaporizer, the first connection terminal being configured to supply a working voltage to the vaporizer and the second connection terminal being configured to supply a ground voltage to the vaporizer during power supply of the battery rod to the vaporizer;

a detection circuit connected to the first connection terminal and the second connection terminal and configured to detect a temperature of a thermocouple formed by a vaporization element in the vaporizer, and to supply a reference voltage to the second connection terminal to detect a temperature of the vaporization element in the vaporizer connected to the battery rod in a forward direction or a reverse direction;

an upper arm driving circuit connected to the first connection terminal and configured to supply the working voltage to the vaporizer by using the first connection terminal during the power supply of the battery rod to the vaporizer; and a lower arm driving circuit connected to the second connection terminal and configured to supply the ground voltage to the vaporizer by using the second connection terminal during the power supply of the battery rod to the vaporizer, and to stop supplying the ground voltage to the second connection terminal when the detection circuit detects the temperature of the vaporization element such that a potential at the second connection terminal varies with a potential of the reference voltage supplied by the detection circuit, wherein, when the battery rod is connected to the vaporizer in the forward direction and the detection circuit detects the temperature of the vaporization element, a high potential terminal of the thermocouple formed by the vaporization element is connected to the first connection terminal, a low potential terminal of the thermocouple is connected to the second connection terminal, and the detection circuit detects a first detection voltage signal between the first connection terminal and the second connection terminal indicating the temperature of the vaporization element, the first detection voltage signal being higher than the reference voltage, and wherein, when the battery rod is connected to the vaporizer in the reverse direction and the detection circuit detects the temperature of the vaporization element, a high potential terminal of the thermocouple formed by the vaporization element is connected to the second connection terminal, a low potential of the thermocouple is connected to the first connection terminal, and the detection circuit detects a second detection voltage signal between the first connection terminal and the second connection terminal indicating the temperature of the vaporization element, the second detection voltage signal being lower than the reference voltage and higher than the ground voltage.

2. The battery rod of claim 1, wherein the detection circuit comprises:

a reference voltage supply circuit connected to the second connection terminal and configured to supply the reference voltage to the second connection terminal; and a signal amplification circuit connected to the first connection terminal and the second connection terminal and configured to amplify the first detection voltage signal or the second detection voltage signal so as to generate an amplified detection signal.

3. The battery rod of claim 2, further comprising:

a control unit connected to the signal amplification circuit and the reference voltage supply circuit, the control unit being configured to determine the temperature of the vaporization element based on the reference voltage and the amplified detection signal.

4. The battery rod of claim 3, wherein the upper arm driving circuit comprises: a first switch comprising a control terminal, a first connecting terminal, and a second connecting terminal, the control terminal of the first switch being connected to the control unit, the first connecting terminal being configured to receive the working voltage, and the second connecting terminal being connected to the first connection terminal, and wherein the lower arm driving circuit comprises: a second switch comprising a control terminal, a first connecting terminal, and a second connecting terminal, the control terminal of the second switch being connected to the control unit, the first connecting terminal being configured to receive the ground voltage, and the second connecting terminal being connected to the second connection terminal, wherein, in a heating stage of vaporization, the control circuit is configured to control the first switch and the second switch to be turned on so that the upper arm driving circuit supplies the working voltage to the first connection terminal by using the first switch that is turned on, and the lower arm driving circuit supplies the ground voltage to the second connection terminal by using the second switch that is turned on, and wherein, in a temperature detection stage, the control unit is configured to control the first switch and the second switch to be turned off to stop supplying the working voltage to the first connection terminal and the ground voltage to the second connection terminal so that the reference voltage supplied by the detection circuit causes the potential at the second connection terminal to vary with the potential of the reference voltage.

5. The battery rod of claim 4, wherein the upper arm driving circuit further comprises a first resistor connected between the control terminal of the first switch and the first connecting terminal, and wherein the lower arm driving circuit further comprises a second resistor connected between the control terminal of the second switch and the first connecting terminal.

6. The battery rod of claim 4, wherein the first switch comprises a P-type MOS transistor, and wherein the second switch comprises an N-type MOS transistor.

7. The battery rod of claim 1, further comprising:

a compensation temperature sensor, arranged close to the first connection terminal and the second connection terminal of the battery rod and configured to detect a cold end temperature of the thermocouple formed by the vaporization element when the vaporizer is connected to the battery rod and the detection circuit detects the temperature of the vaporization element so as to further accurately detect the temperature of the vaporization element.

8. An electronic vaporization device, comprising:

a vaporizer; and the battery rod of claim 1.

* * * * *